US011437698B2

(12) United States Patent
Holzer et al.

(10) Patent No.: US 11,437,698 B2
(45) Date of Patent: Sep. 6, 2022

(54) N-WAY RING COMBINER/DIVIDER

(71) Applicant: University of Utah Research Foundation, Salt Lake City, UT (US)

(72) Inventors: Kyle David Holzer, Bountiful, UT (US); Jeffrey Walling, Salt Lake City, UT (US)

(73) Assignee: L3HARRIS TECHNOLOGIES, INC., Melbourne, FL (US)

( * ) Notice: Subject to any disclaimer, the term of this patent is extended or adjusted under 35 U.S.C. 154(b) by 0 days.

(21) Appl. No.: 16/619,459

(22) PCT Filed: Jun. 5, 2018

(86) PCT No.: PCT/US2018/036155
§ 371 (c)(1),
(2) Date: Dec. 5, 2019

(87) PCT Pub. No.: WO2018/226763
PCT Pub. Date: Dec. 13, 2018

(65) Prior Publication Data

US 2020/0168975 A1 May 28, 2020

Related U.S. Application Data

(60) Provisional application No. 62/515,246, filed on Jun. 5, 2017.

(51) Int. Cl.

| | |
|---|---|
| ***H01P 5/22*** | (2006.01) |
| ***H01P 5/19*** | (2006.01) |
| ***H01P 5/12*** | (2006.01) |

(52) U.S. Cl.
CPC ..... *H01P 5/19* (2013.01); *H01P 5/12* (2013.01); *H01P 5/22* (2013.01)

(58) Field of Classification Search
CPC ..... H01P 5/22; H01P 5/19; H01P 5/12; H01P 5/222; H01P 5/225; H01P 1/32; H01P 1/38; H01P 1/36
USPC ..... 333/100, 120, 1.1, 24.2
See application file for complete search history.

(56) References Cited

U.S. PATENT DOCUMENTS

| | | | | |
|---|---|---|---|---|
| 5,107,223 | A | 4/1992 | Sakai et al. | |
| 7,616,058 | B1 | 11/2009 | Nezakati et al. | |
| 2011/0140802 | A1* | 6/2011 | Pruvost | H01P 5/225 333/100 |

OTHER PUBLICATIONS

International Search Report and Written Opinion issued in PCT/US2018/036155 dated Aug. 28, 2018.

* cited by examiner

*Primary Examiner* — Stephen E. Jones
(74) *Attorney, Agent, or Firm* — Workman Nydegger

(57) ABSTRACT

A magnet-less multi-port ring combiner comprises a set of ports extending from the circumference of the magnet-less multi-port ring combiner. The set of ports are positioned at ¼ increments around the circumference of the magnet-less multi-port ring combiner. The set of ports comprise a first input port configured to receive a first input signal and a second input port configured to receive a second input signal, wherein the first input signal is 180° out-of-phase with the second input signal. The N-way magnet-less multi-port combiner comprises more than four ports.

14 Claims, 4 Drawing Sheets

PCT/US2018/036155

N-WAY RING COMBINER/DIVIDER

CROSS-REFERENCE TO RELATED APPLICATIONS

This application claims priority to PCT Application No. PCT/US2018/036155, filed Jun. 5, 2018 entitled "N-WAY RING COMBINER/DIVIDER," which claims priority to and the benefit of U.S. Provisional Application Ser. No. 62/515,246 entitled "N-WAY RING COMBINER/DIVIDER", filed on Jun. 5, 2017, the entire content of which are incorporated by reference herein in their entirety.

BACKGROUND

Within the field of electrical circuit design, circulators are used for combining and dividing signals. Conventional circulators comprise four ports that allow for input and output. In some configurations, circulators can consume significantly less physical real-estate of a circuit board than other conventional dividers and couplers, such as a Wilkinson divider.

Within conventional planar power combining structures inputs are typically arranged in parallel with each signal path traveling through a unique combination of traces not common to all the signals until the output port of the combiner. In the case of magnetic ring combiners/dividers, the current from each input typically flows in a single direction due to the magnetic field that is generated by the magnet. These various configurations have several shortcomings relating to physical size, costs, and performance. There is a need in the field for designs that overcome these various limitations.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Disclosed embodiments include a magnet-less multi-port ring combiner. The N-way magnet-less multi-port combiner comprises a set of ports extending from the circumference of the magnet-less multi-port ring combiner. In at least one embodiment, the set of ports are positioned at λ/4 increments around the circumference of the magnet-less multi-port ring combiner. The set of ports comprise a first input port configured to receive a first input signal and a second input port configured to receive a second input signal, wherein the first input signal is 180° out-of-phase with the second input signal. In at least one embodiment, the N-way magnet-less multi-port combiner comprises more than four ports.

Additional disclosed embodiments include a magnet-less multi-port combiner that comprises a set of ports extending from an outer boundary of the magnet-less multi-port combiner. The set of ports are positioned at λ/4 increments around the outer boundary of the magnet-less multi-port combiner. Additionally, the set of ports comprise a first group of input ports that are spaced around the outer boundary at multiples of λ/2 from each other. The magnet-less multi-port combiner consists of passive components.

Further disclosed embodiments include a magnet-less multi-port ring combiner that comprises a set of ports extending from a circumference of the magnet-less multi-port ring combiner. The set of ports are positioned at λ/4 increments around the circumference of the magnet-less multi-port ring combiner. Additionally, relative to each input port, all other input ports are at 180° out-of-phase signal nulls. Also, relative to each output port, all other output ports are at 180° out-of-phase signal nulls. Any two ports are connected by two discrete and non-overlapping paths.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Disclosed embodiments include passive circuit components that are capable of dividing and/or combining input signals. Additionally, disclosed embodiments provide a high-degree of isolation between signals within the circuit. Disclosed embodiments are configurable to be constructed within a printed circuit board without the use of a magnet.

At least one disclosed embodiment comprises a scalable ring combiner-divider having the advantages of a ring hybrid and is scalable to N-way number of ports. Various disclosed embodiments may conform to one or more design rules that cause various desired attributes within the scalable ring combiner-divider. For example, in at least one embodiment, the desirable attributes include that a generalized set of design rules for N-way ring combiners must be a superset of existing ring combiners, including the ring hybrid.

In an additional embodiment, a desirable attribute may include input ports of a group sharing the same relative phase difference between output ports. For example, one input port group may comprise the same relative phase distance between Σ and Δ output ports (shown in FIG. 6) and the other input port group has a 180° delta between output ports. In at least one embodiment, it is not critical that ports in the same input group share the same absolute phase length, as additional port specific phase shifts can be added prior to ring inputs to enable in-phase combination of all input group signals at the output ports.

In yet another embodiment, a desirable attribute may include that relative to each input port all other input ports are at 180° out-of-phase signal nulls. This may be desirable because high input port isolation can reduce undesirable ring loading caused by varied inputs impedances.

Additionally, in at least one embodiment, a desirable attribute includes isolation between output ports. For example, relative to each output port all other output ports are at 180° out-of-phase signal nulls. High output port isolation can reduce undesirable ring loading caused by varied output impedances and enables signal separation between the Σ and Δ ports.

In a further embodiment, a desirable attribute includes that any two ports are connected by two discrete and non-overlapping paths. For example, the ring consists of a single non-overlapping path, either conducted or waveguide, from each port and returning to that port. Each round-trip port signal path is completely overlapping with every other round-trip port signal path on the ring. In at least one embodiment, the ring is not required to be circular in shape but will be depicted as such herein for ease of analysis.

Figure 1A:
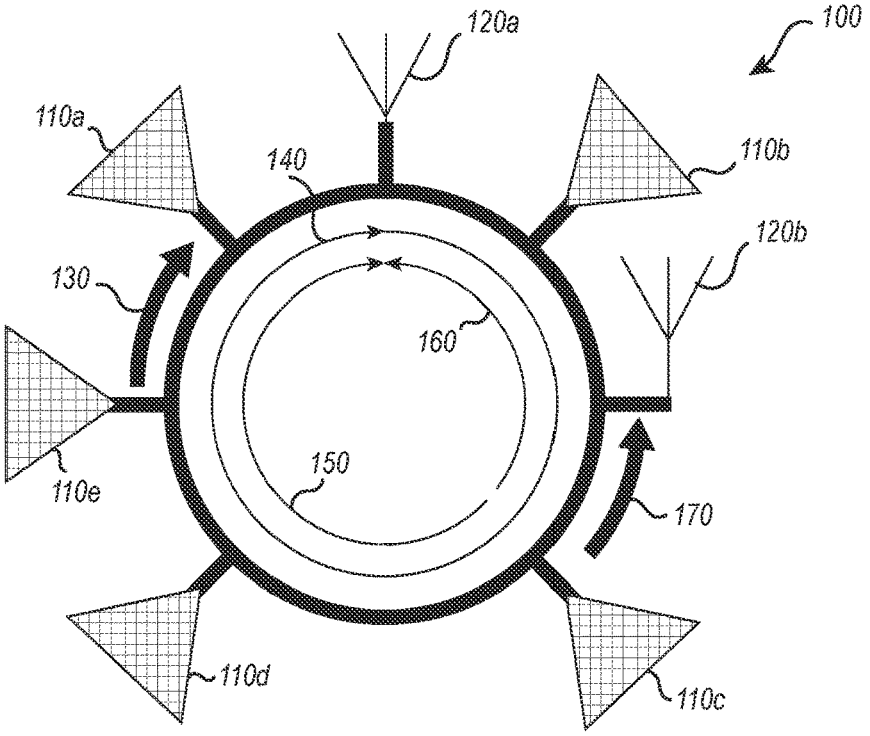
FIG. 1A illustrates an embodiment of a N-way ring combiner/divider.

An embodiment of a power combiner configuration 100 is shown in FIG. 1A with input ports 110(*a-e*) shown as amp ports and output ports 120(*a, b*) shown as antenna ports. Within a divider embodiment configuration these input/output designations are reversed correspondingly. Distances are shown with Amp to Amp spacing 130, Ring circumference 140, Amp to Antenna spacing 170, left hand trip from Amp to Antenna 160, and right-hand trip from Amp to Antenna 150.

In at least one embodiment, input port spacing 130 ("S") is described by the following equation:

$$S = \frac{x\lambda}{2} \text{ where } x = \ldots, -1, 0, 1, \ldots \qquad \text{Equation 1}$$

Using Equation 1, the input port spacing 130 satisfies the above desired attributes.

Electromagnetic waves travel with sinusoidal propagation. As the nulls are now established to occur with λ/2 periodicity around the ring from each input port, the maxima will occur halfway between the nulls. Possible output port locations occur at each maxima to maximize ring combiner/divider efficiency. Input to output port spacing 170 ("A") is given with Equation 2.

$$A = \frac{\lambda}{4} + \frac{y\lambda}{2} \text{ where } y = \ldots, -1, 0, 1, \ldots \qquad \text{Equation 2}$$

Ring circumference 140 is derived through a combination of Equation 1 and Equation 2. Equation 3 is the result showing possible N-way scalable ring circumferences ("C").

$$C = \frac{\lambda}{2} + z\lambda \text{ where } z = \ldots, -1, 0, 1, \ldots \qquad \text{Equation 3}$$

Per these equations, in at least one embodiment, the spacing between any available adjacent port is λ/4. The number and location of ports within these equations is set by application specific requirements. In at least one embodiment, an equal number of input ports in each group is necessary to balance the constructive and destructive signal combination. Additional input ports can be populated but not used, held in reserve as an automatic replacement option if another input port in that group fails. System MTTF can be increased in this way. Σ and Δ output ports can each consist of multiple output antenna ports when multiple equally weighted output ports are needed.

The scalable ring design equations are satisfied for any ring of C=nλ+180° with 2+n4 number of ports, where n=1, 2, 3 . . . .

Accordingly, disclosed embodiments comprise N-way ring power combiner-dividers that have advantages over conventional WDC and WDC variants. N-way rings provide a common delta port that can be used for output port selection, energy harvesting, thermal management, et. al. Design rules are given for the N-way ring designs. The design equations provide a flexible number of N-way ring sizes.

Within conventional combining structures, avoiding signal path mismatch places difficult constraints on process, voltage, and temperature (PVT) variations across the combiner-divider structure. The design complexity increases when a higher number of power combining input ports are used due to manufacturing variations. Additionally, phase differences in adjacent paths cause finite signal energy loss in isolation resistors or isolation ports for each combiner pair in the combination network. For multi-level outphasing applications where large phase differences between combining legs are intentional, the loss in each isolation resistor or isolation port can be significant, especially for signals with large peak-to-average power ratios (PAPR). Recapturing this energy through energy harvesting is more difficult due to the multiple points of load.

Accordingly, disclosed embodiments include an alternative to conventional radial and ladder-based combiners. For example, disclosed embodiments include the use of N-way ring combiners, where N represents the number of ports. In at least one embodiment, the circular geometry allows a more compact design allowing greater flexibility when incorporating the multi-way ring combiner into a device. Additionally, the ring combiner comprises fewer discontinuities that impact the impedance.

Figure 1B:
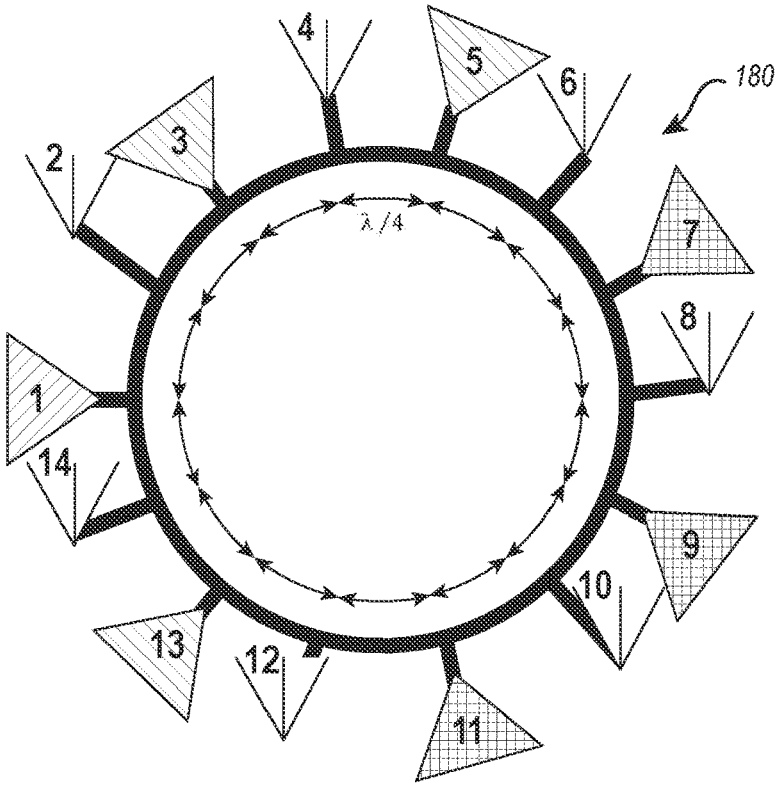
FIG. 1B illustrates an embodiment of a N-way ring combiner/divider.

For example, FIG. 1B illustrates an embodiment of a N-way ring combiner/divider 180. In the depicted ring combiner 180, all inputs from the amplifiers have two paths with equal phase delay to the desired output port. Additionally, the combined paths propagate through the same trace sections, minimizing mismatches due to PVT variations. Finally, the combiner can be designed such that it provides a common output (Σ) port and isolation (Δ) port. This simplifies operation and allows for easier thermal energy harvesting, as there is a single point of load for all combiner losses.

The N-way ring combiner 180 comprises an electrical length of 1260° around the circumference. Additionally, the N-way ring combiner 180 comprises a circumference of fourteen λ/4 sections, resulting in a maximum of 14 ports (ports 1-14). In the presented embodiment, six of the ports are used as inputs (Ports 1, 3, 5, 7, 9, 11, and 13), and two of the ports are used as outputs (e.g., Ports 6 and 12), resulting in a N-way power combiner. The combiner can be generalized to allow inputs at any odd numbered port, and outputs at any even numbered port, with the phase relationships (wrapped to π) shown below in Table 1.

TABLE 1

6-WAY RELATIVE PORT PHASES

| | | Ring Outputs | | | | | | |
|---|---|---|---|---|---|---|---|---|
| | | Port 2 | Port 4 | Port 6 | Port 8 | Port 10 | Port 12 | Port 14 |
| Ring Inputs | Port 1 | 90° | 270° | 90° | 270° | 90° | 270° | 90° |
| | Port 3 | 90° | 90° | 270° | 90° | 270° | 90° | 270° |
| | Port 5 | 270° | 90° | 90° | 270° | 90° | 270° | 90° |
| | Port 7 | 90° | 270° | 90° | 90° | 270° | 90° | 270° |
| | Port 9 | 270° | 90° | 270° | 90° | 90° | 270° | 90° |
| | Port 11 | 90° | 270° | 90° | 270° | 90° | 90° | 270° |
| | Port 13 | 270° | 90° | 270° | 90° | 270° | 90° | 90° |

If all input ports were driven with phase-synchronized wave-forms, the output seen at each port would be a combination of constructive and destructive additions with relative phase shifts as shown. Both the Σ and the Δ ports can be selected and populated as a single or multiple ports. These ports can be inverted by introducing a 180° phase delay in half of the input ports driving signals.

Figure 2:
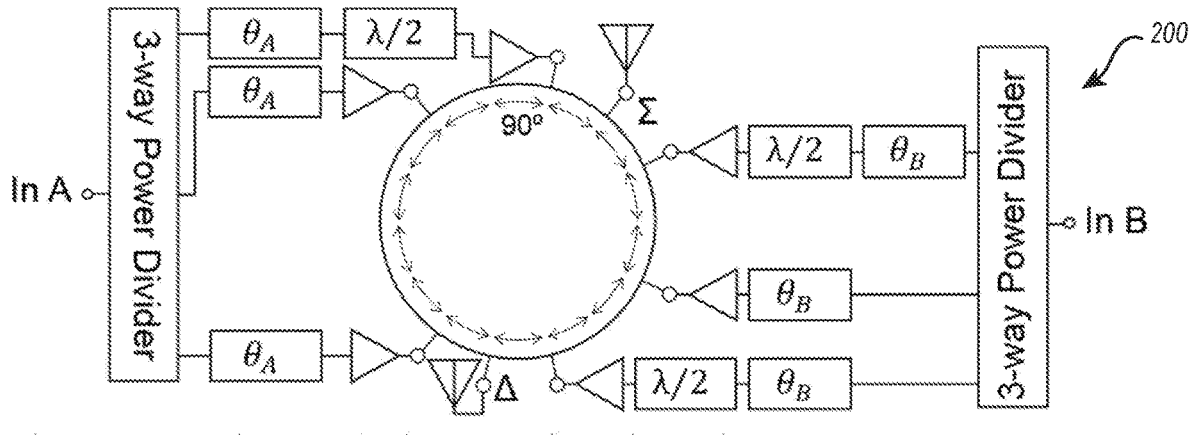
FIG. 2 illustrates an embodiment of a N-way ring outphasing amplifier schematic.

In at least one embodiment, the N-way ring combiner 180 comprises an 8-port combiner, featuring 6 input ports (e.g., Ports 3, 5, 7, 9, 11, 13) driving two output ports (e.g., Ports 6, 12). FIG. 2 illustrates an embodiment of a N-way ring outphasing amplifier schematic 200. The input ports are grouped into two different groups, as shown in FIG. 2. Input ports 3, 5, and 13 are the first input group, while input ports 7, 9, and 11 are the second. Ports 6 and 12 are the output ports designated as Σ and Δ. The input port groups share the same relative phase difference between the output ports, although not the same absolute phase. By inverting the phase of either input group by 180°, the output ports are automatically inverted in function between Σ and Δ, allowing for port switching without requiring a lossy switch.

From the phasing relationships in Table 1, the s-parameter matrix for the presented combiner is given as follows:

TABLE 1

$$S = i/\sqrt{2}\begin{pmatrix} 0 & 0 & -1 & 0 & 0 & 0 & 1 & 0 \\ 0 & 0 & 1 & 0 & 0 & 0 & -1 & 0 \\ -1 & 1 & 0 & 1 & -1 & 1 & 0 & -1 \\ 0 & 0 & 1 & 0 & 0 & 0 & 1 & 0 \\ 0 & 0 & -1 & 0 & 0 & 0 & -1 & 0 \\ 0 & 0 & 1 & 1 & 0 & 0 & 1 & 0 \\ 1 & -1 & 0 & 1 & -1 & 1 & 0 & 1 \\ 0 & 0 & -1 & 0 & 0 & 0 & 1 & 0 \end{pmatrix}$$

In at least one embodiment, a number of additional or alternative 6-way port selections can be made with this 14-port ring; the selected ports chosen for this implementation provide a straight forward line of symmetry through the center of the ring directly between ports 1 and 8.

Figure 3:
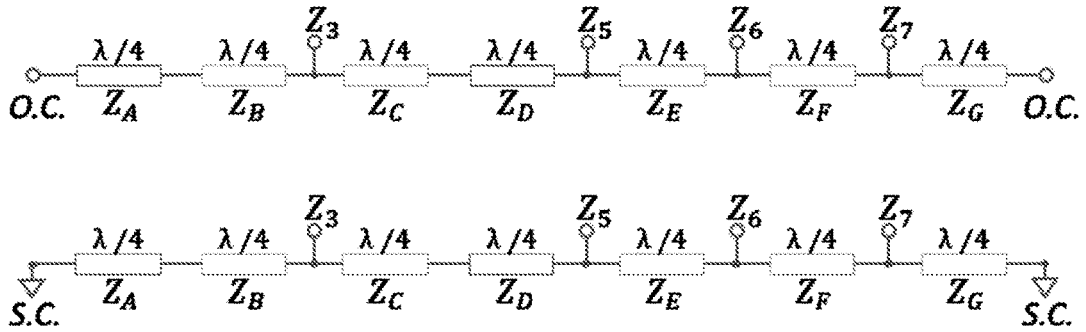
FIG. 3 illustrates a schematic view of embodiments of even-mode and odd-mode analysis.

FIG. 3 illustrates a schematic view of embodiments of even-mode and odd-mode analysis. Using the transmission line (TL) analysis for the quarter wave segments that are terminated by open-circuits (O.C.) and short-circuits (S.C.), the impedance of the segments at the output port, $Z_E$ and $Z_F$ are given by the following:

$$Z_E = \sqrt{Z_5 Z_6}$$

$$Z_F = \sqrt{Z_6 Z_7}$$

Hence, the impedances of the λ/4 TL segments are given by the driving impedances of the circuits attached at the output ports and their adjacent ports. Note that in the disclosed embodiment ports 6 and 12 are related by symmetry, so the analysis is the same for those sections. The remaining λ/4 sections of the ring are chosen to be the same value to maximize impedance continuity around the ring.

Combining N amplifiers in phase is a method of achieving higher output powers that would be difficult to achieve with single devices. This can also provide reduced costs, as single, high-power devices can be significantly more expensive than a lower power counterpart. Finally, power combining allows the thermal loading to be spread out across a larger surface area, easing the cooling burden on the system.

As depicted in FIG. 2, each input is followed by a 3-way T-junction splitter with equally weighted 150Ω λ/4 output section followed by another λ/4 matching section to return to 50Ω. These segments are designated as $\theta_A$. Ports 5, 7 and 11 have an additional fixed 180° phase length in line to account for the relative phase offset. The phase length of each signal path from the input of the amplifiers to the input of the ring is matched for each input group. Note that the inputs for groups 1 and 2 have a constant, static phase offset that can be used to tune the center frequency of the isolation.

Figure 4:
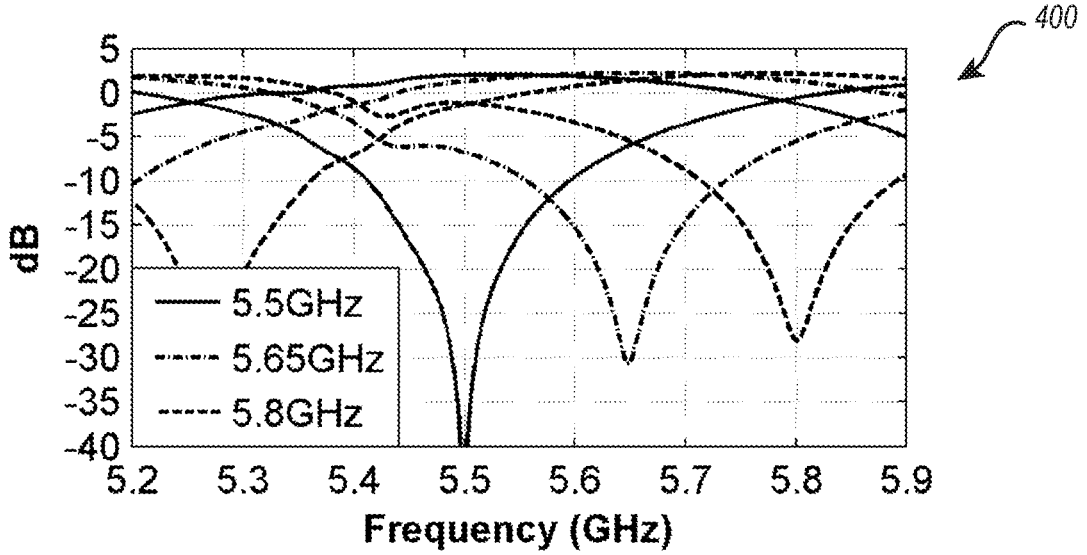
FIG. 4 illustrates a graph depicting insertion loss and isolation for an embodiment of a N-way ring passive combiner.

FIG. 4 illustrates a graph 400 depicting insertion loss and isolation for an embodiment of a N-way ring passive combiner. In at least one embodiment, the N-way ring passive combiner consists of passive components, such that no active components are present within the N-way ring passive combiner. Simulation and measured results are shown in FIG. 4 for varied phase off-sets between group 1 and 2 inputs. The insertion loss through the passive combiner depicted in FIG. 4 is <0.97 dB at 5.5 GHz. By tuning the relative phase shift between the outphasing input ports, the isolation center frequency is tuned as shown for 5.5 GHz, 5.65 GHz and 5.8 GHz. The passive ring provides >25 dB of isolation when tuned to the different frequencies and provides >44 dB of output isolation at 5.5 GHz (e.g., the centerband frequency of the TL segments).

Figure 5:
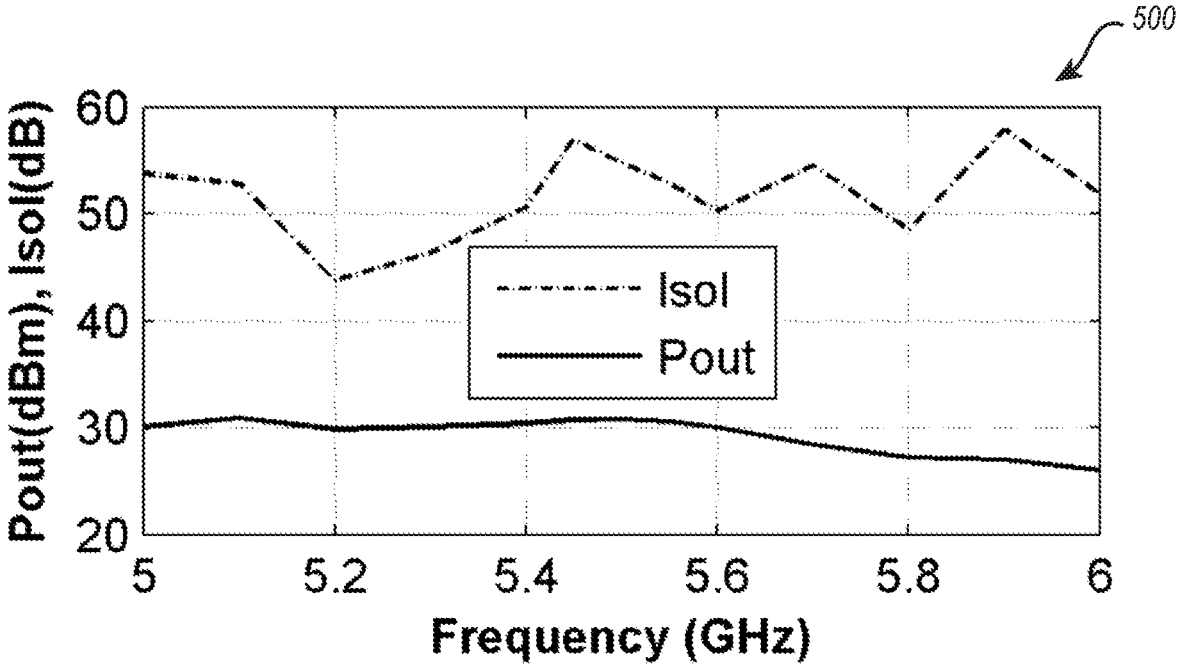
FIG. 5 illustrates a graph depicting output power and isolation for an embodiment of a N-way ring passive combiner.

FIG. 5 illustrates a graph 500 depicting output power and isolation for an embodiment of a N-way ring passive combiner. The static input phase difference is varied to tune the isolation frequency across the band from 5-6 GHz. The achieved isolation across the band is greater than 44 dBc. The instantaneous bandwidth is similar to the small-signal isolation shown in FIG. 4.

Figure 6:
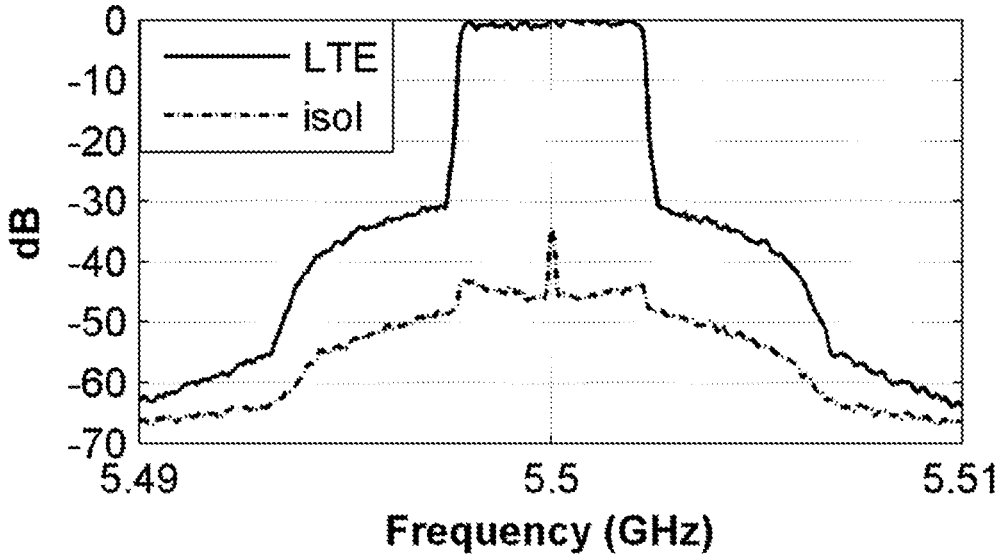
FIG. 6 illustrates a graph depicting measured PSD for an embodiment of a 6-way ring passive combiner.

FIG. 6 illustrates a graph depicting measured PSD for an embodiment of a 6-way ring passive combiner. To validate the performance with a modulated signal, a 24.1 dBm 5 MHz LTE waveform is measured with >35 dBc ACLR for E-UTRA, as shown in FIG. 6. Note, this is not a single-carrier OFDM signal, hence the peak-to-average power ratio (PAPR) is ≈6.5 dB. The measured isolation of the modulated signal is >35dBc. In at least one embodiment, this could be improved with digital pre-distortion, which was not included in these measurements.

Accordingly, disclosed embodiments present an N-way ring combiner/divider that offers advantages over traditional ladder and radial based combiners. Notably, the N-way ring combiner provides a common D port for isolation. In addition to its combining features, it can be used for output port selection, energy harvesting, thermal management, etc. In at least one embodiment, the combiner achieves peak isolation of >44 dBc across a frequency range that can be tuned by controlling the static phase offset between the input groups. Additionally, it can be used for outphasing modulation, though the presented implementation uses linear amplification with static phase off-sets. The power handling is only limited by the trace widths and PCB material, hence higher powers are achievable.

Disclosed embodiments include a magnet-less multi-port ring combiner. The N-way magnet-less multi-port combiner comprises a set of ports extending from the circumference of the magnet-less multi-port ring combiner. In at least one embodiment, the set of ports are positioned at λ/4 increments around the circumference of the magnet-less multi-port ring combiner. The set of ports comprise a first input port configured to receive a first input signal and a second input port configured to receive a second input signal, wherein the first input signal is 180° out-of-phase with the second input signal. In at least one embodiment, the N-way magnet-less multi-port combiner comprises more than four ports.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A magnet-less multi-port ring combiner comprising:

a set of ports extending from a single continuous trace of the magnet-less multi-port ring combiner, wherein the set of ports are positioned at λ/4 increments around an electrically continuous circumference of the magnet-less multi-port ring combiner; and the set of ports comprise a first input port configured to receive a first input signal and a second input port configured to receive a second input signal, wherein the first input signal is 180° out-of-phase with the second input signal, wherein:

the set of ports comprise more than four ports, and relative to each input port, all other input ports are at 180° out-of-phase signal nulls, relative to each output port, all other output ports are at 180° out-of-phase signal nulls.

2. The multi-port ring combiner of claim 1, wherein the set of ports comprise six ports.

3. The multi-port ring combiner of claim 1, wherein a first group of input ports share a common relative phase difference between output ports.

4. The multi-port ring combiner of claim 1, wherein any two ports are connected by two discrete and non-overlapping paths.

5. The multi-port ring combiner of claim 1, wherein the combiner comprises a shape other than circular.

6. The multi-port ring combiner of claim 1, wherein input ports selected from the set of ports are spaced at multiples of λ/2 from each other.

7. The multi-port ring combiner of claim 1, wherein the magnet-less multi-port ring combiner consists of passive components.

8. A magnet-less multi-port combiner comprising:

a set of ports extending from a single continuous trace of the magnet-less multi-port combiner, wherein the set of ports are positioned at λ/4 increments around the single continuous trace of the magnet-less multi-port combiner;

the set of ports comprise a first group of input ports that are spaced around the single continuous trace at multiples of λ/2 from each other; and wherein:

the magnet-less multi-port combiner consists of passive components, the set of ports comprise more than four ports, and relative to each input port, all other input ports are at 180° out-of-phase signal nulls, relative to each output port, all other output ports are at 180° out-of-phase signal nulls.

9. The multi-port combiner of claim 8, wherein the set of ports comprise six ports.

10. The multi-port combiner of claim 8, wherein the first group of input ports share a common relative phase difference between output ports.

11. The multi-port combiner of claim 8, wherein any two ports are connected by two discrete and non-overlapping paths.

12. The multi-port combiner of claim 8, wherein the combiner comprises a shape other than circular.

13. The multi-port combiner of claim 8, wherein the combiner comprises a circular shape.

14. A magnet-less multi-port ring combiner comprising:

a set of ports extending from a single continuous trace of the magnet-less multi-port ring combiner, wherein the set of ports are positioned at λ/4 increments around the an electrically continuous circumference of the magnet-less multi-port ring combiner; and wherein:

the set of ports comprise more than four ports, relative to each input port, all other input ports are at 180° out-of-phase signal nulls, relative to each output port, all other output ports are at 180° out-of-phase signal nulls, and any two ports are connected by two discrete and non-overlapping paths.

* * * * *